US005762572A

United States Patent [19]

Chuang

[11] Patent Number: 5,762,572

[45] Date of Patent: Jun. 9, 1998

[54] TENNIS RACKET HAVING AN AUXILIARY HANDLE

[76] Inventor: Chao-Sheng Chuang, No. 582, Kang Yen Rd., Kang Shan Chen, Kaohsiung Hsien, Taiwan

[21] Appl. No.: 865,404

[22] Filed: Jun. 2, 1997

[30] Foreign Application Priority Data

Oct. 29, 1996 [TW] Taiwan ..... 85216582

[51] Int. Cl.[6] ..... A63B 49/08

[52] U.S. Cl. ..... 473/551; 473/526

[58] Field of Search ..... 473/526, 538, 473/549, 551, 173, 183

[56] References Cited

U.S. PATENT DOCUMENTS

| | | | |
|---|---|---|---|
| 2,795,426 | 6/1957 | Wood | 473/526 |
| 5,183,260 | 2/1993 | Khen | 473/526 |
| 5,366,218 | 11/1994 | Gong | 473/551 |

FOREIGN PATENT DOCUMENTS

| | | | |
|---|---|---|---|
| 2528319 | 12/1983 | France | 473/183 |
| 1428820 | 12/1968 | Germany | 473/183 |
| 3404831 | 8/1985 | Germany | 473/183 |

*Primary Examiner*—William E. Stoll

*Attorney, Agent, or Firm*—Hedman, Gibson & Costigan, P.C.

[57] ABSTRACT

A tennis racket includes a ball striking surface, a handle connected with the ball striking surface, and an auxiliary handle attached to one side face of the handle and perpendicularly disposed to the ball striking surface.

6 Claims, 5 Drawing Sheets

TENNIS RACKET HAVING AN AUXILIARY HANDLE

FIELD OF THE INVENTION

The present invention relates to a tennis racket having an auxiliary handle.

BACKGROUND OF THE INVENTION

A conventional tennis racket is shown in FIG. 8. There will be a complete illustration in the detailed description of the preferred embodiments.

The present invention has arisen to mitigate and/or obviate the disadvantage of the conventional tennis racket.

SUMMARY OF THE INVENTION

In accordance with one aspect of the present invention, there is provided a tennis racket comprising a ball striking surface, a handle connected to the ball striking surface, and an auxiliary handle attached to one side face of the handle and perpendicularly disposed to the ball striking surface.

Further features of the present invention will become apparent from a careful reading of the detailed description with appropriate reference to the accompanying drawings.

DETAILED DESCRIPTION OF THE PREFERRED EMBODIMENTS

Figure 8:
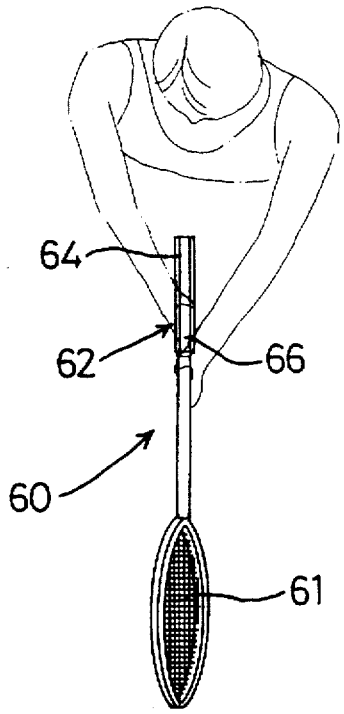
FIG.8 PRIOR ART
FIG. 8 is a top plan operational view of a conventional tennis racket in accordance with the prior art.

For a better understanding of the features and benefits of the present invention, reference is now made to FIG. 8, illustrating a conventional tennis racket 60 according to the prior art.

The conventional tennis racket 60 comprises a ball striking surface 61 connected to a handle 62. By such an arrangement, however, when a tennis player has to perform a backhand stroke, he/she has to hold a first end portion 64 of the handle 62 in his/her right hand and hold a second end portion 66 of the handle 62 in his/her left hand synchronously such that the operation of the player's left hand easily interferes with that of the player's right hand, causing a hindrance to the player's striking operation during the backhand stroke.

Figure 1:
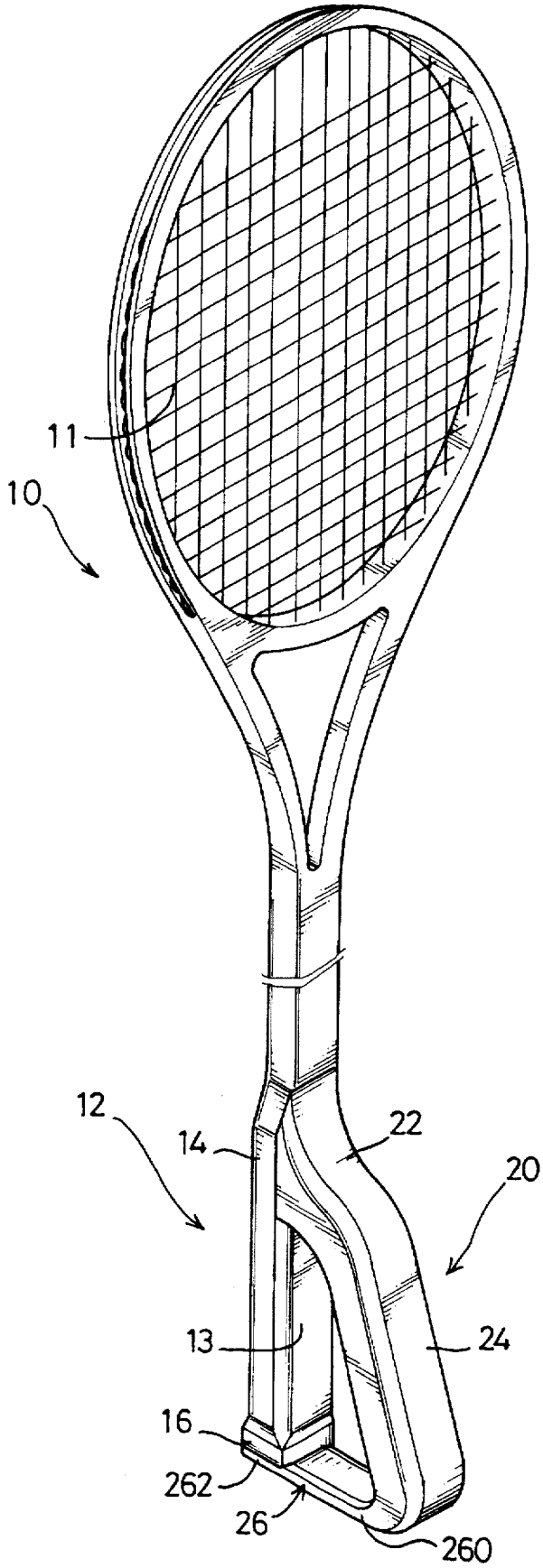
FIG. 1 is a perspective view of a tennis racket in accordance with the present invention.
Figure 3:
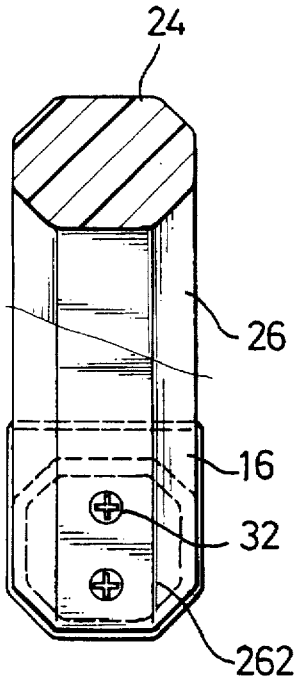
FIG. 3 is partial bottom plan cross-sectional view of FIG. 1.
Figure 2:
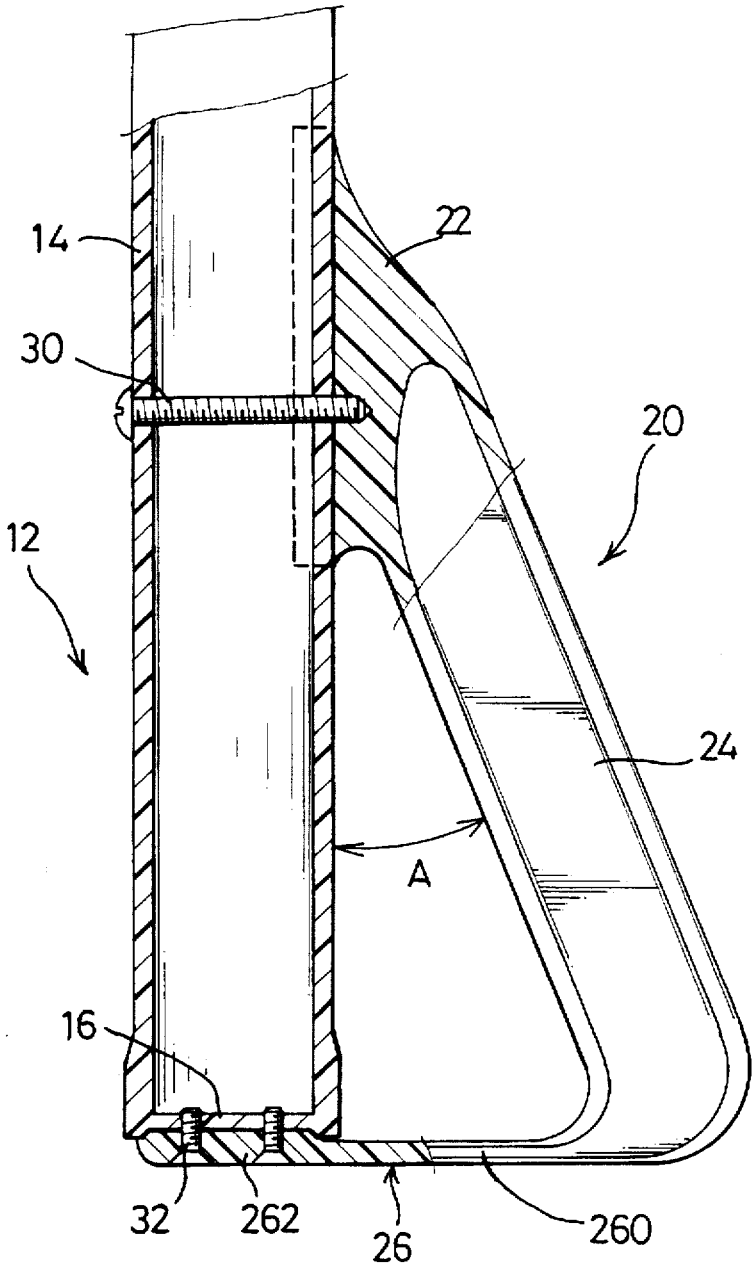
FIG. 2 is a partial side cross-sectional view of FIG. 1.

Referring initially to FIGS. 1–3, a tennis racket 10 in accordance with the present invention comprises a ball striking surface 11, an upright handle 12 connected to the ball striking surface 11, and an auxiliary handle 20 fixedly attached to one flat side face 13 of the handle 12 and perpendicularly disposed to the ball striking surface 11.

The auxiliary handle 20 includes an upper extension 22 fixedly mounted on a mediate portion 14 of the handle 12, a shank 24 having an upper end portion extending from the upper extension 22 and a lower end portion extending downwardly, and a lower extension 26 having a first end portion 260 extending from the lower end portion of the shank 24 toward a lower end portion 16 of the handle 12 and a second end portion 262 fixedly mounted on the lower end portion 16 of the handle 12.

The upper extension 22 has a length smaller than that of the lower extension 26 such that the shank 24 is disposed at an inclined angle A relative to the handle 12. The inclined angle A between the handle 12 and the shank 24 of the auxiliary handle 20 is greater than ten degrees and smaller than thirty degrees. Optimally, the inclined angle A is substantially equal to twenty degrees.

A positioning member 30, such as a screw bolt, extends through the mediate portion 14 of the handle 12 and is engaged in the upper extension 22 of the auxiliary handle 20, thereby fixing the upper extension 22 of the auxiliary handle 20 to the mediate portion 14 of the handle 12.

Two positioning screws 32 each extend through the second end portion 262 of the lower extension 26 and are engaged in the lower end portion 16 of the handle 12, thereby fixing the second end portion 262 of the lower extension 26 to the lower end portion 16 of the handle 12.

Figure 4:
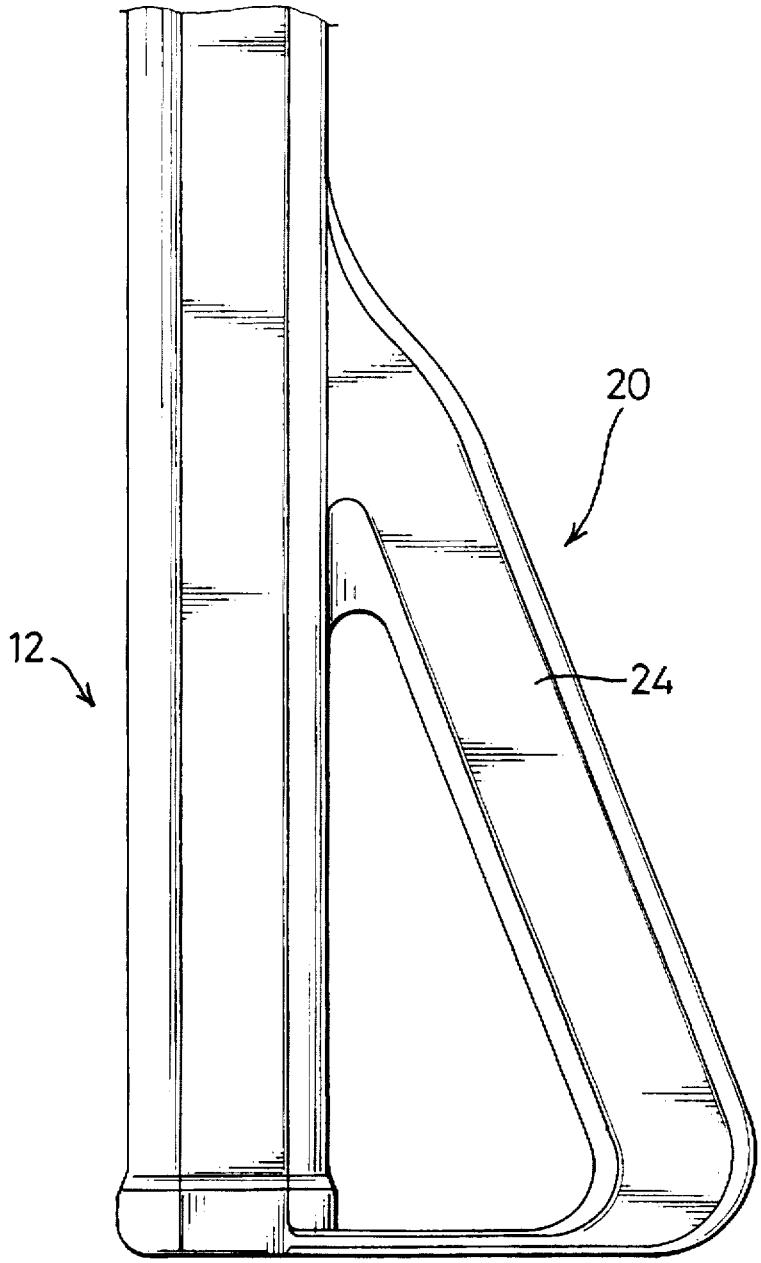
FIG. 4 is a partial side view of a tennis racket in accordance with another embodiment of the present invention.

Referring to FIG. 4, in accordance with another embodiment of the present invention, the auxiliary handle 20 can be integrally formed with the handle 12.

Figure 5:
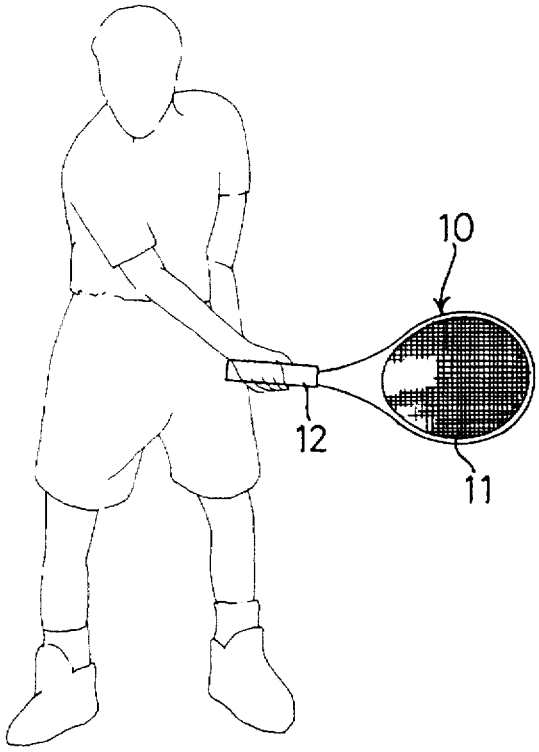
FIGS. 5 and 6 are operational views of the tennis racket of FIG. 1.
Figure 6:
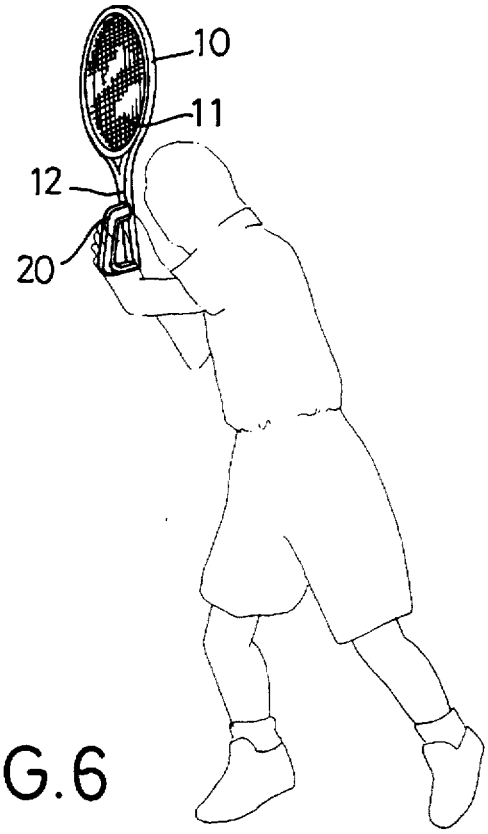
Figure 7:
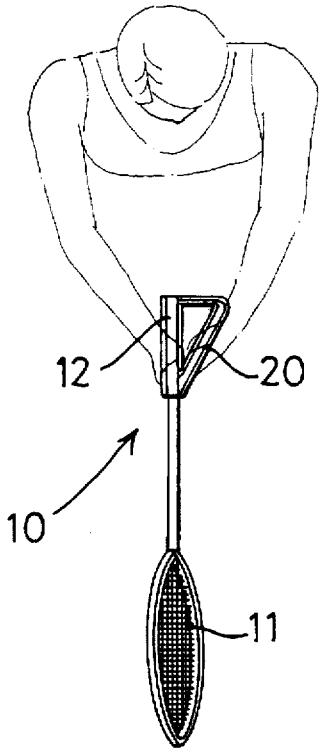
FIG. 7 is a top plan operational view of the tennis racket of FIG. 1.

In operation, referring to FIGS. 5–7 with reference to FIG. 1, when a tennis player has to perform a backhand stroke, the player can hold the handle 12 in his right hand and can hold the auxiliary handle 20 in his left hand synchronously such that the auxiliary handle 20 can be used to provide assistance to the player's left hand, without the possibility of interfering with the operation of his right hand, thereby facilitating the player's striking operation during the backhand stroke.

Especially referring to FIGS. 7 and 8, it is clear that the auxiliary handle 20 can be used to provide an excellent effect for assisting the player's backhand stroke.

It should be clear to those skilled in the art that further embodiments of the present invention may be made without departing from the scope and spirit of the present invention.

What is claimed is:

1. A tennis racket comprising:

a ball striking surface;

a handle including an upper end portion fixedly connected to said ball striking surface, a mediate portion, and a lower end portion; and an auxiliary handle attached to said handle and including an upper extension fixedly mounted on said mediate portion of said handle, a shank having an upper end portion extending from said upper extension and a lower end portion extending downwardly, and a lower extension having a first end portion extending from said lower end portion of said shank toward said lower end portion of said handle and a second end portion fixedly mounted on said lower end portion of said handle, and said lower extension having a length greater than that of said upper extension such that said shank is disposed at an inclined angle relative to said handle.

2. The tennis racket according to claim 1, wherein said inclined angle between said handle and said shank of said auxiliary handle is substantially equal to twenty degrees.

3. The tennis racket according to claim 1, wherein said inclined angle between said handle and said shank of said auxiliary handle is greater than ten degrees and is smaller than thirty degrees.

4. The tennis racket according to claim 1, further comprising a positioning member extending through the mediate portion of said handle and engaged in said upper extension of said auxiliary handle, thereby fixing said upper extension of said auxiliary handle to the mediate portion of said handle.

5. The tennis racket according to claim 1, further comprising at least one positioning screw extending through the second end portion of said lower extension and engaged in the lower end portion of said handle, thereby fixing the second end portion of said lower extension to the lower end portion of said handle.

6. The tennis racket according to claim 1, wherein said auxiliary handle is integrally formed with said handle.

* * * * *